United States Patent [19]

Washburn

[11] Patent Number: 4,782,758

[45] Date of Patent: Nov. 8, 1988

[54] AMMUNITION ROUND

[75] Inventor: William J. Washburn, San Clemente, Calif.

[73] Assignee: AeroJet-General Corporation, La Jolla, Calif.

[21] Appl. No.: 942,553

[22] Filed: Dec. 16, 1986

Related U.S. Application Data

[63] Continuation of Ser. No. 825,429, Feb. 3, 1986, abandoned.

[51] Int. Cl.[4] ..... F42B 5/02

[52] U.S. Cl. ..... 102/434; 102/430; 102/439; 102/501

[58] Field of Search ..... 102/430–434, 102/443, 501, 439

[56] References Cited

U.S. PATENT DOCUMENTS 562,535 6/1896 Hurst ..... 102/443
3,009,394 11/1961 Kamp et al. ..... 102/434
4,197,801 4/1980 La Fever et al. ..... 102/433
4,335,657 6/1982 Bains ..... 102/443
4,604,954 8/1986 Clarke et al. ..... 102/434

FOREIGN PATENT DOCUMENTS 4841 4/1892 Switzerland ..... 102/433

*Primary Examiner*—Harold J. Tudor
*Attorney, Agent, or Firm*—Leonard Tachner

[57] ABSTRACT

An improved telescoped ammunition round having a projectile comprising an aft recess to receive a booster tube that is affixed to the cartridge case and which remains stationary relative to the cartridge case throughout the firing sequence. The booster tube is provided with a primer to ignite the booster charge and is positioned within the projectile recess to initially propel the projectile and subsequently ignite the main propellant within the cartridge case after the projectile has been forced at least partially into the gun barrel.

4 Claims, 2 Drawing Sheets

AMMUNITION ROUND

This is a continuation of application Ser. No. 825,429, filed Feb. 3, 1986, now abandoned.

BACKGROUND OF THE IVENTION

1. Field of the Invention

The present invention relates generally to an apparatus for improving the ballistic performance of an ammunition round and more particularly, to an improved form of telescoped ammunition with superior and more reproducible interior and exterior ballistics performance.

2. Prior Art

Telescoped caseless ammunition is comprised of a propellant charge having an axial bore or cavity, a projectile housed entirely within the axial bore of the propellant charge and a primer positioned aft of the projectile. When a telescoped round of ammunition is loaded into the chamber of a gun, the projectile being housed in a propellant charge is not seated in the barrel of the gun as is the projectile of a round of conventional ammunition when in a gun chamber. Upon initiation of the primer of the telescoped round, the projectile is forced forward into the barrel of the gun and becomes seated in the barrel. The telescoped ammunition concept provides a method of packaging the ballistic components of high performance ammunition that significantly reduces total cartridge volume. This reduced volume can be converted to improved gun and feed system density in volume limited environments.

The general concept of telescoped ammunition is old in the art. By way of example, U.S. Pat. No. 4,197,801 and U.S. Pat. No. 4,335,657 disclose alternative configurations for telescoped ammunition rounds. Unfortunately, while such prior art discloses concepts for telescoped ammunition rounds, the particular physical implementations of the respective disclosures suffer from a number of significant disadvantages which render the mass production of such rounds of questionable worth. For example, each such prior art patent discloses the use of a relatively complex interface between the projectile and the remaining components of the ammunition round which significantly increases the cost of the ammunition. More importantly, each incurs significant performance degradation in the form of non-reproducible ballistic performance both within the round and exterior to the round subsequent to the firing of the projectile. By way of further example, one of the disadvantages of the earlier patent which is discussed in the later patent is that the earlier patent teaches using a mechanical action to control the firing sequence of the telescoped ammunition round but that such mechanical action involves the use of a piston which is ejected from the ammunition round when the ammunition is fired. It was of course recognized in the latter patent that the ejection of debris upon firing the round may cause damage to the environment surrounding the gun such as the exterior of an aircraft. The latter patent purports to solve this clear disadvantage of the earlier patent by providing a stop ring for limiting forward movement of the piston beyond a preselected location thereby retaining the piston within the ammunition round. However, such a stop ring merely adds to the complexity of the ammunition round and in any case does not remedy the inconsistent performance of such rounds which is due at least in part to the movement of the piston as a means for utilizing ignition gases to ignite the main propellant.

SUMMARY OF THE INVENTION

The present invention overcomes the aforementioned disadvantages of the prior art by providing a telescoped ammunition round of drastically modified configuration as compared to the prior art. More specifically, this invention recognizes that it is highly advantageous and unique to provide a telescoped ammunition cartridge in which there is no moving piston required in order to initiate forward motion of the projectile before ignition of the main propellant. As a result, the present invention need not incur the disadvantageous piston ejecting action of the prior art nor need it incur the complex structural requirements in order to retain a moving piston within the ammunition after the projectile is fired. Furthermore, providing a telescoped ammunition round in which only the projectile moves during firing, significantly enhances the precision of the interaction between the initial ignition gases and the main propellant charge thereby rendering the present invention a much more consistent and reproducible form of ammunition round.

The present invention is characterized by a projectile the aft end of which has a cylindrically-shaped booster tube recess concentrically located relative to the axis of the projectile. The invention also comprises a substantially cylindrical cartridge case containing a propellant grain charge which provides an axial cavity for receiving the projectile and substantially surrounding the projectile with the aforementioned propellant charge. The forward end of the cartridge case has a circular opening adapted to allow passage of the projectile after firing and is provided with a case end cap which is provided with Mylar membrane environmental seal for enclosing the projectile opening to avoid contamination of the propellant grain charge. The rear end of the cartridge case is provided with a thickened portion the center of which provides a threaded opening for receiving the novel booster tube of the present invention. The booster tube, when threaded into the rear portion of the cartridge case, remains stationary and affixed to the cartridge case throughout the firing process. The booster tube extends into the booster tube recess in the rear end of the projectile and contains a booster charge whereby to provide means for initial acceleration of the projectile prior to ignition of the propellant as will be hereinafter more fully explained. The projectile and booster tube are interconnected by means of a plastic split ring which holds the projectile within the cartridge case and is adapted to be sheared upon firing the projectile.

This relatively simple and low cost means for interfacing the projectile and the cartridge case makes it possible to provide a boat-tailed shaped end of the rear portion of the projectile which lowers the drag on the projectile. It will be seen hereinafter that upon firing of the projectile in the telescoped ammunition round of the present invention, the booster tube remains fixed relative to the cartridge case and no portion of the booster tube moves with the projectile. Consequently, unlike the prior art there is no piston that moves with the projectile within the interior of the cartridge and it is quite evident that there is also no piston that remains attached to the projectile outside the cartridge case which would also significantly lower the velocity of the projectile.

OBJECTS OF THE INVENTION

It is therefore a principal object of the present invention to provide an improved telescoped ammunition round which significantly reduces or entirely overcomes the noted disadvantages of the prior art.

It is an additional object of the present invention to provide an improved telescoped ammunition round which utilizes simpler and lower cost components and assembly which has improved performance both interior and exterior to the cartridge case and which solves the piston problem associated with the prior art.

It is still an additional object of the present invention to provide an improved telescoped ammunition round wherein the cartridge case normally associated with the projectile in such types of ammunition is provided with means for affixing thereto a booster tube which remains stationary relative to the cartridge case throughout the firing of the ammunition round and further providing a projectile having means for receiving a portion of the booster tube along the aft end thereof for initial acceleration of the projectile upon primer initiation before the main propellant bed is ignited.

BRIEF DESCRIPTION OF THE DRAWINGS

The aforementioned objects and advantages of the present invention as well as additional objects and advantages thereof will be more fully understood hereinafter as a result of a detailed description of a preferred embodiment when taken in conjunction with the following drawings in which.

DETAILED DESCRIPTION OF A PREFERRED EMBODIMENT

Figure 1:
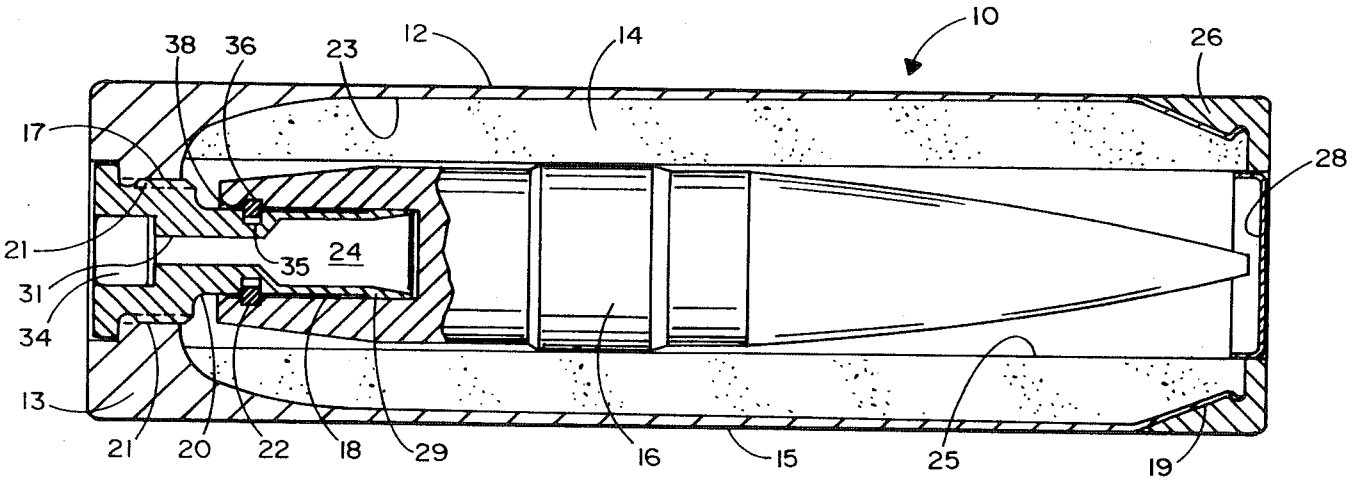
FIG. 1 is a partially cross-sectioned plan view of the ammunition round of the present invention.
Figure 2:
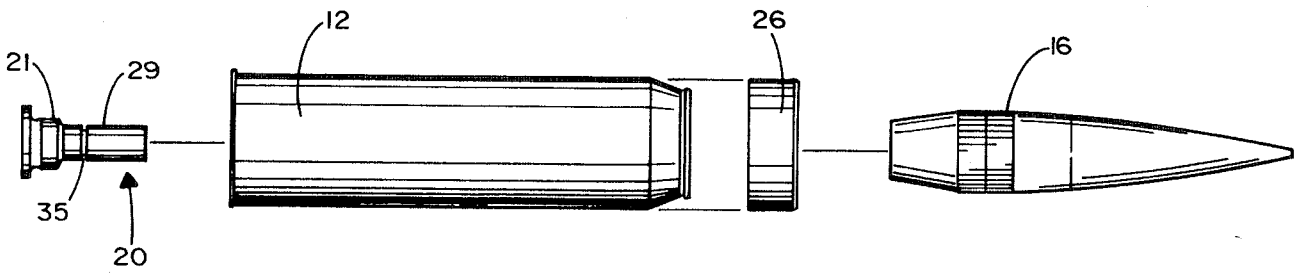
FIG. 2 is an exploded view of the present invention illustrating the components thereof.

Referring now to FIGS. 1 and 2 it will be seen that the ammunition round 10 of the present invention comprises four principal components, namely, a cartridge case 12, a projectile 16, a booster tube 20 and a case end cap 26. As seen best in FIG. 1, cartridge case 12 is of a generally cylindrical configuration having a thicker end portion 13 which is provided with a threaded aperture 17. However, the majority of the cartridge case 12 is formed of a relatively thin radial skin 15 which terminates at the end opposite thickened end portion 13 in a tapered end 19 which is adapted to receive case end cap 26 in a press fit configuration. The interior of cartridge case 12 forms a cavity 23 which is adapted to receive the propellant grain 14 in which a cylindrical bore 25 is provided to receive the projectile 16. Projectile 16 is generally of a standard low drag profile and thus substantially standard as compared to prior art projectiles used in telescoping ammunition except that the projectile 16 of the present invention is provided with a novel booster tube recess 18 at its aft end. Recess 18 is of a substantially cylindrical configuration and it is positioned axially relative to the longitudinal axis of the projectile as seen best in FIG. 1.

Booster tube 20, is as seen in FIGS. 1 and 2, a generally cylindrically shaped object having a threaded portion 21 of increased diameter adapted to engage the corresponding threaded aperture 17 of the cartridge case 12. Booster tube 20 also has a tube portion 29 which is adapted to extend into the booster tube recess 18 of the projectile 16 and for that purpose is substantially congruent therewith. A booster charge 24 is contained within the tube portion 29 of the booster tube 20 and extends toward the threaded portion 21 of the booster tube 20 through an elongated charge chamber 31 which extends to a primer 34 positioned concentrically within the threaded portion 21.

Those having skill in the art to which the present invention pertains will understand that the physical relationship between the booster charged 24 contained within the tube portion 29 of booster tube 20, is channeled through channel 31 to the primer 34 whereby to permit ignition of the booster charge within the booster tube upon activation of the primer to generate the initial acceleration of the projectile 16 before the propellant grain 14 has been ignited. Both the tube portion 29 of the booster tube 20 and the corresponding portion of the booster tube recess 18 within the projectile 16 are provided with matching annular recesses 35 and 36 respectively which are aligned to receive a split ring 22. Split ring 22 is preferably made of a plastic material readily sheared upon firing of the projectile but is also of sufficient strength to secure the projectile to the booster tube within the cartridge case prior to firing of the projectile. The rear surface of projectile 16 adjacent the booster tube recess 18 is provided with a conical recess 38 which enables easy assembly of the ammunition round of the present invention by merely press fitting the projectile over the tube portion 29 of the booster tube 20 until the split ring 22 engages both annular recesses 35 and 36 concurrently as shown best in FIG. 1.

The front end of the cartridge case 12 as previously noted is provided with a tapered end 19 which is designed to be press fit into case end cap 26. Case end cap 26 is provided with an aperture to match the cylindrical bore 25 formed by the propellant grain 14. This aperture of the case end cap is preferably provided with a Mylar membrane environmental seal 28 when the ammunition round 10 of the present invention is fully assembled. This prevents contamination thereof during shipping and storage. Environmental seal 28 is automatically removed upon firing the round as a result of passage of the projectile 16 through the cylindrical bore 25 during firing.

Figure 3:
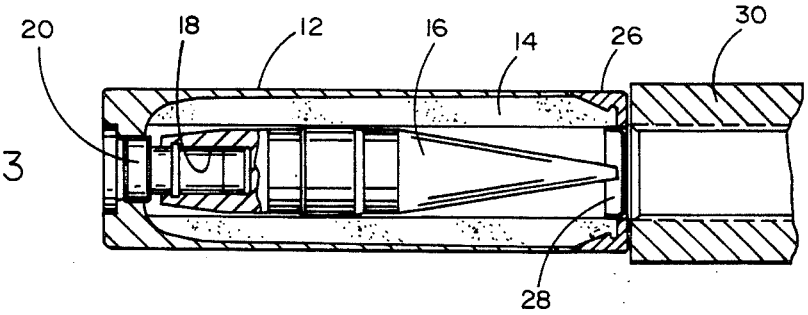
FIGS. 3 through 6 provide sequential illustrations of the operational sequence of the present invention during firing of the ammunition round thereof.

The firing sequence of the ammunition round 10 of the present invention may be best understood while referring to FIGS. 3 through 6. In each such figure the ammunition round 10 of the present invention is shown positioned adjacent a coaxial gun barrel 30 through which the projectile passes during the firing process. The configuration shown in FIG. 3 is essentially identical to that shown in FIG. 1 illustrating that at the instant the primer 34 is initiated neither the booster charge 24 nor the propellant grain charge 14 has been ignited and the projectile is in its stored configuration relative to the cartridge case 12 and booster tube 20.

Figure 4:
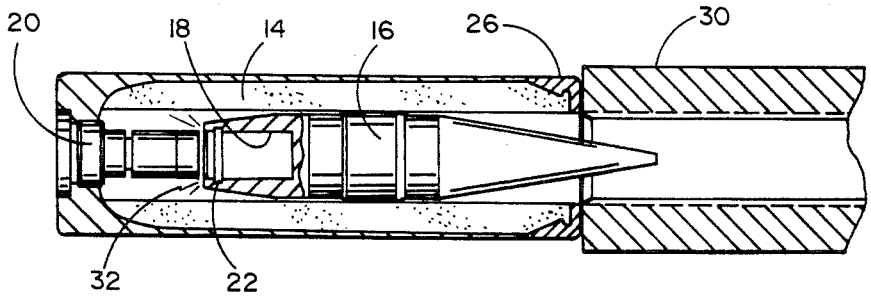

The configuration of the ammunition round 10 of the present invention illustrated in FIG. 4 corresponds to the point in time subsequent to the initiation of the primer wherein the booster charge 24 has been ignited thereby propelling the projectile away from the booster tube and toward the gun barrel 30 while shearing the split ring 22 to permit separation between the projectile and the booster tube. Furthermore, the configuration of FIG. 4 illustrates the position of the projectile 16 in a sufficiently forward position relative to the booster tube 20 wherein ignition gases 32 have reached the main propellant grain charge 14 to thereby ignite the main propellant grain charge.

Figure 5:
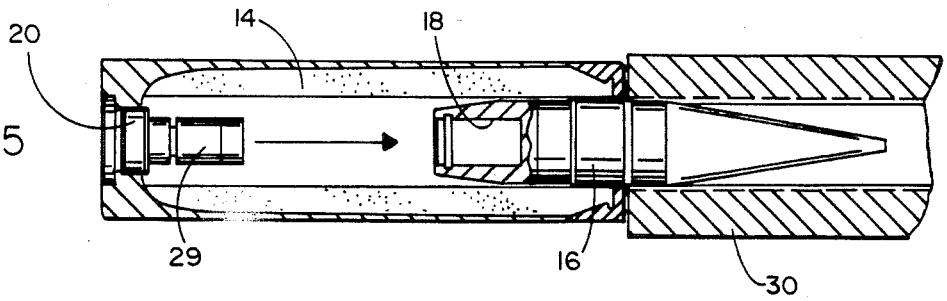

The configuration illustrated in FIG. 5 corresponds to the point in time of the firing sequence in which the projectile is approximately halfway into the gun barrel 30 and the projectile has begun to obturate as pressure from the main propellant bed 14 ignited by the ignition gases 32 of the booster charge 24, has begun to rise.

Figure 6:
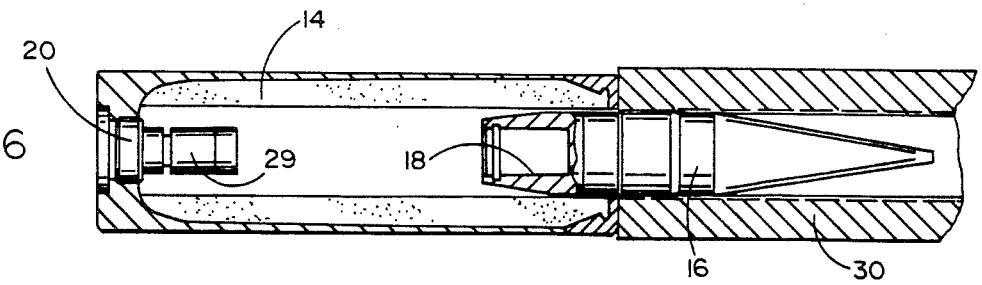

FIG. 6 illustrates the point in time during the firing sequence in which the majority of the projectile 16 has entered the gun barrel 30 and the projectile is being accelerated by the full gas pressure of the main propellant grain charge 14. Subsequent to the point in time illustrated by FIG. 6 the firing sequence continues in a fairly conventional manner which will be apparent to those having skill in the art to which the present invention pertains and which therefore need not be described herein in detail. It is interesting to note however that as represented in the sequence of FIGS. 3 through 6, the booster tube 20 including the tube portion 29 at all times during the firing sequence remains stationary relative to the cartridge case 12 thereby overcoming the noted deficiencies of the prior art previously discussed.

It will now be understood that what has been disclosed herein comprises a novel, improved telescoped ammunition round including a projectile having a booster tube recess at the art end thereof adapted for receiving a booster tube having a booster charge therein connected to a primer, the booster tube being threadably engaged with the cartridge case whereby to remain stationary relative to the cartridge case during the entire firing sequence. Thus the present invention obviates the prior art use of moving pistons as well as the prior art requirement for complex mechanism for retaining a piston within the cartridge case during the firing process. Consequently, the present invention provides a simple but elegant solution to the problems associated with prior art telescoped ammunition rounds thereby providing such a round in a configuration which is less costly to produce and more reliable in performance.

Those having skill in the art to which the present invention pertains will now, as a result of the applicant's teaching herein, perceive various modifications and additions to the invention. By way of example, alternative configurations for the booster tube/projectile interface as well as other alternative means for securing the booster tube to the cartridge case will now become apparent. However, all such modifications and additions are deemed to be within the scope of the present invention which is to be limited only by the claims appended thereto.

I claim:

1. An improved telescoped ammunition round having a projectile and a cartridge case, said cartridge case having a main propellant charge forming an axial bore for receiving said projectile, the projectile having a forward end and an aft end; the improvement comprising:

an imperforate booster tube having (1) a closed first end affixed to said cartridge case adjacent the aft end of said projectile and extending toward said projectile within said axial bore to an open second end, and (2) a first annular recess formed in an external surface of said booster, said projectile being contained within said cartridge case and having an axial recess extending from its aft end for receiving said second end of said booster tube, said axial recess including an internal conical portion, a cylindrical portion and a second annular recess interfacing with said conical portion and said cylindrical portion therebetween, where said internal conical portion extends from said projectile aft end toward said second annular recess, said booster tube including a frangible retaining means for releasably coupling said projectile to said booster tube when each of said respective first and second annular recesses are aligned each to the other, said frangible retaining means being contained at least partially within each of said annular recesses, said booster tube further having means for generating ignition gases within said projectile recess for propelling said projectile away from said booster tube within said bore whereby said gases are exposed to said main propellant charge at said second end of said booster tube for igniting said main propellant charge after predetermined motion of said projectile.

2. The improved round of claim where said frangible retaining means is sheared upon motion of said projectile in response to said ignition gases.

3. The improved round of claim 1 wherein said cartridge case comprises a threaded aperture adjacent the aft end of said projectile and wherein said booster tube comprises a threaded portion for threadably mating said cartridge case within said threaded aperture.

4. The improved round of claim 1 wherein said means for generating ignition gases comprises a booster charge within said booster tube and a primer in communication with said booster charge and accessible external of said cartridge case.

* * * * *